US006648246B1

(12) United States Patent
Chang

(10) Patent No.: US 6,648,246 B1
(45) Date of Patent: Nov. 18, 2003

(54) TRIGGER STRUCTURE FOR SPRAY GUN

(76) Inventor: Ching-Tsung Chang, No. 151 1, Fwu Tay St., U Ryh Hsiang, Taichung Hsien (TW)

( * ) Notice: Subject to any disclaimer, the term of this patent is extended or adjusted under 35 U.S.C. 154(b) by 0 days.

(21) Appl. No.: 10/301,759

(22) Filed: Nov. 22, 2002

(51) Int. Cl.[7] ..... B05B 7/02; B05B 9/01
(52) U.S. Cl. ..... 239/526; 239/525
(58) Field of Search ..... 239/526, 525, 239/570, 574, 600, 527, 528, 529–532

(56) References Cited

U.S. PATENT DOCUMENTS 2,717,806 A * 9/1955 Dale ..... 239/415
2,737,415 A * 3/1956 Wheeler-Nicholson ..... 239/133
3,022,015 A * 2/1962 Burch ..... 239/444
5,967,422 A * 10/1999 Wang ..... 239/526
6,260,774 B1 * 7/2001 Erickson ..... 223/46

* cited by examiner

*Primary Examiner*—Michael Mar
*Assistant Examiner*—Darren Gorman
(74) *Attorney, Agent, or Firm*—Troxell Law Office PLLC

(57) ABSTRACT

A trigger structure for spray gun includes horizontally and rearward extended upper and lower driving shaft adapted to movably engage with upper and lower channels, respectively, formed on a front handle of the spray gun when the trigger structure is assembled to the spray gun. The lower driving shaft forms a supporting point of the trigger structure on the spray gun and defines a suitable travel for the trigger structure, so that a user's finger operating the trigger structure would not contact with a front projection on the front handle when the trigger structure is moved to a rear dead point of its travel.

7 Claims, 6 Drawing Sheets

TRIGGER STRUCTURE FOR SPRAY GUN

BACKGROUND OF THE INVENTION

The present invention relates to a trigger structure for a spray gun, and more particularly to a trigger structure for a spray gun having an additional lower driving shaft that forms a supporting point of the trigger structure on the spray gun and defines a suitable travel for the trigger structure, so that a user's finger operating the trigger structure would not contact with a front projection of the front handle when the trigger structure is moved to a rear dead point of its travel.

There are various types of spray guns available for use. These spray guns have a simple structure as shown in FIGS. 1 to 3, and include a trigger 1 having one rearward extended driving shaft 2 movably received in a channel 3 above a front handle 4 of the spray gun. The trigger 1 is provided at upper and lower front ends with two projections 11, 12 for engaging with upper and lower passages 41, 42, respectively, provided on the front handle 4 when the trigger 1 is assembled to the spray gun. The lower passage 42 is provided on a top of a front projection 43 forward extended from a front side of the front handle 4 to correspond to the upper passage 41. When a user pulls the trigger 1 toward the front handle 4 with a finger pressing against a front end of the trigger 1, the finger would contact with the front projection 43 on the handle 4 when the trigger 1 is fully pulled. Frequent contact of the finger with the front projection 43 during operating the spray gun would cause discomfort to the finger. It is therefore desirable to improve the trigger 1 to eliminate the above-mentioned problem in using the conventional spray guns.

SUMMARY OF THE INVENTION

A primary object of the present invention is to provide an improved trigger structure for spray gun for a user to handle the spray gun comfortably.

To achieve the above and other objects, the trigger structure for spray gun according to the present invention includes horizontally and rearward extended upper and lower driving shaft adapted to movably engage with upper and lower channels, respectively, formed on a front handle of the spray gun when the trigger structure is assembled to the spray gun. The lower driving shaft forms a supporting point of the trigger structure on the spray gun and defines a suitable travel for the trigger structure, so that a user's finger operating the trigger structure would not contact with a front projection on the front handle when the trigger structure is moved to a rear dead point of its travel.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
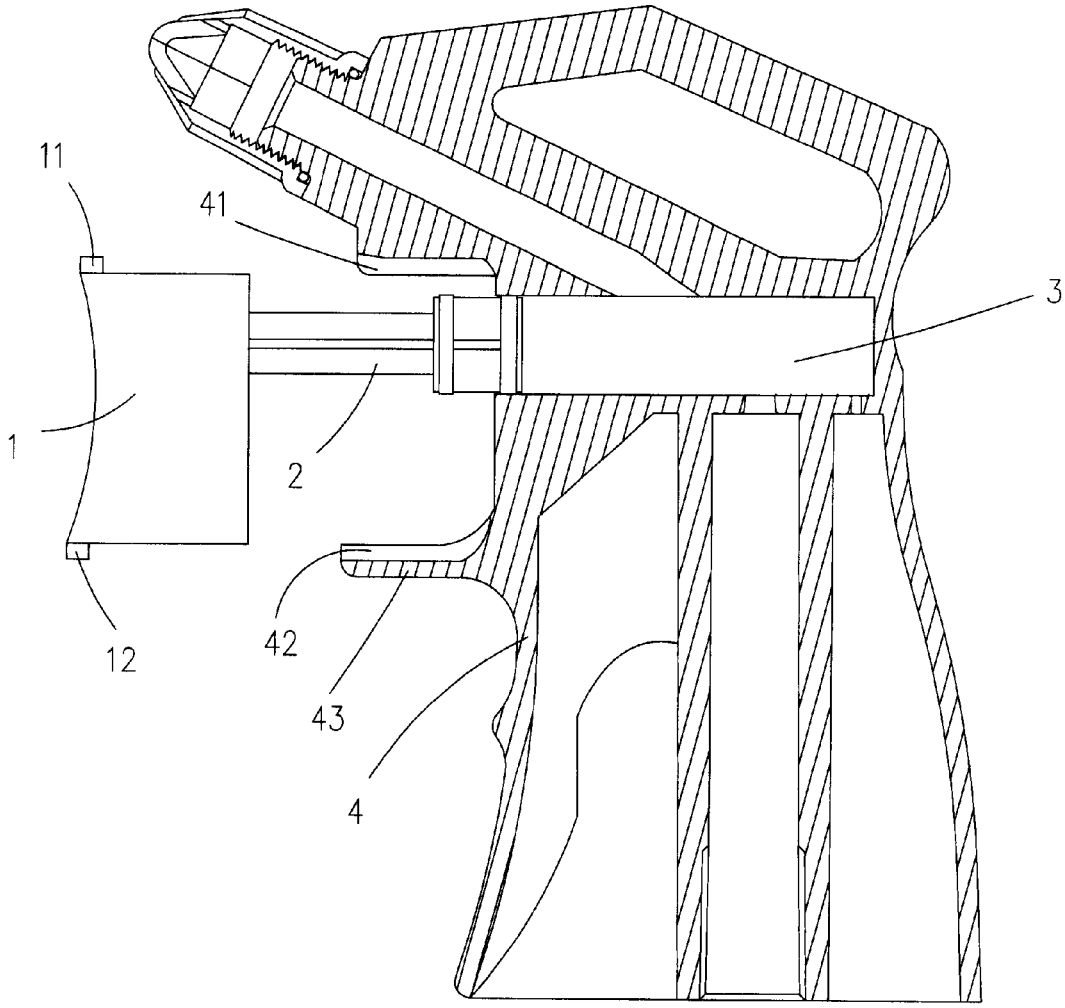
FIG 1 PRIOR ART
FIGS. 1 to 3 are sectioned side views of a conventional spray gun showing operation of a trigger thereof.
Figure 2:
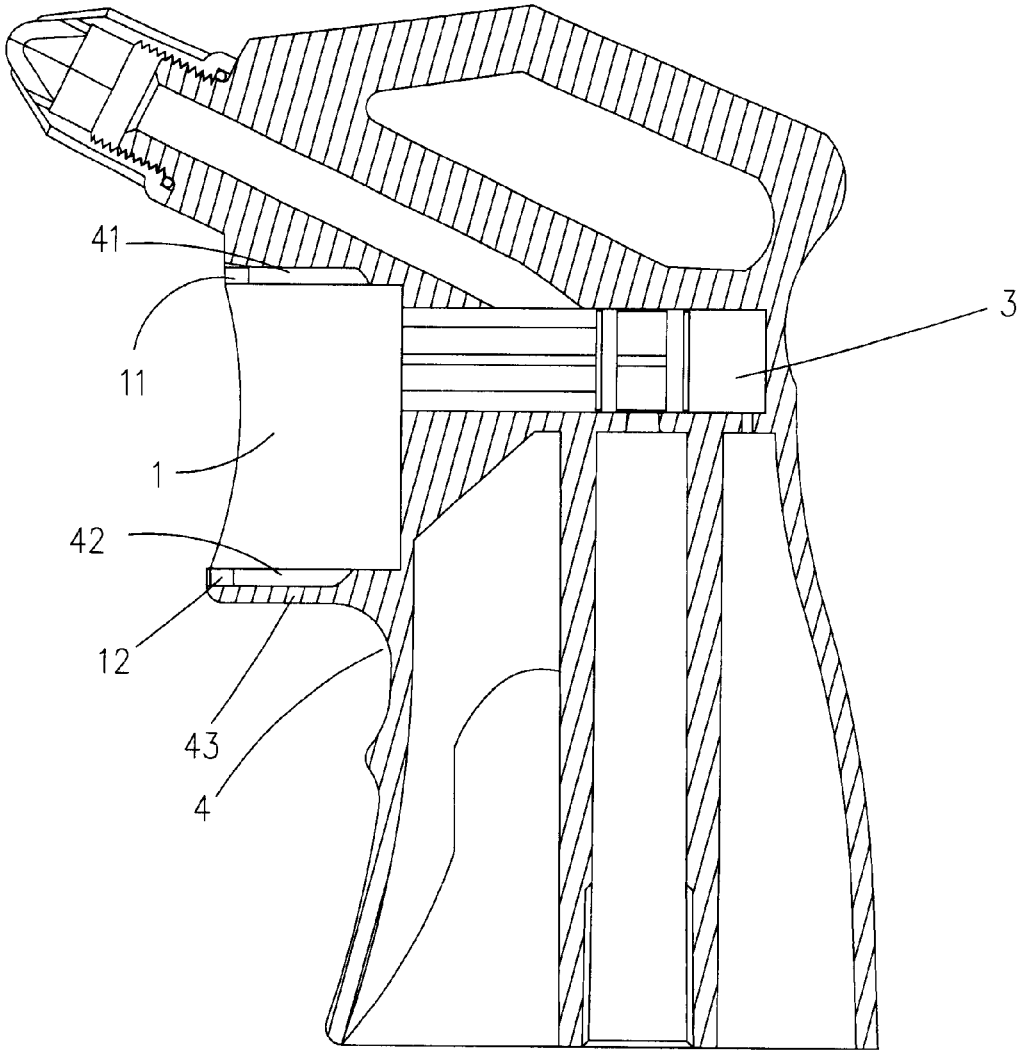
FIG 2 PRIOR ART
Figure 3:
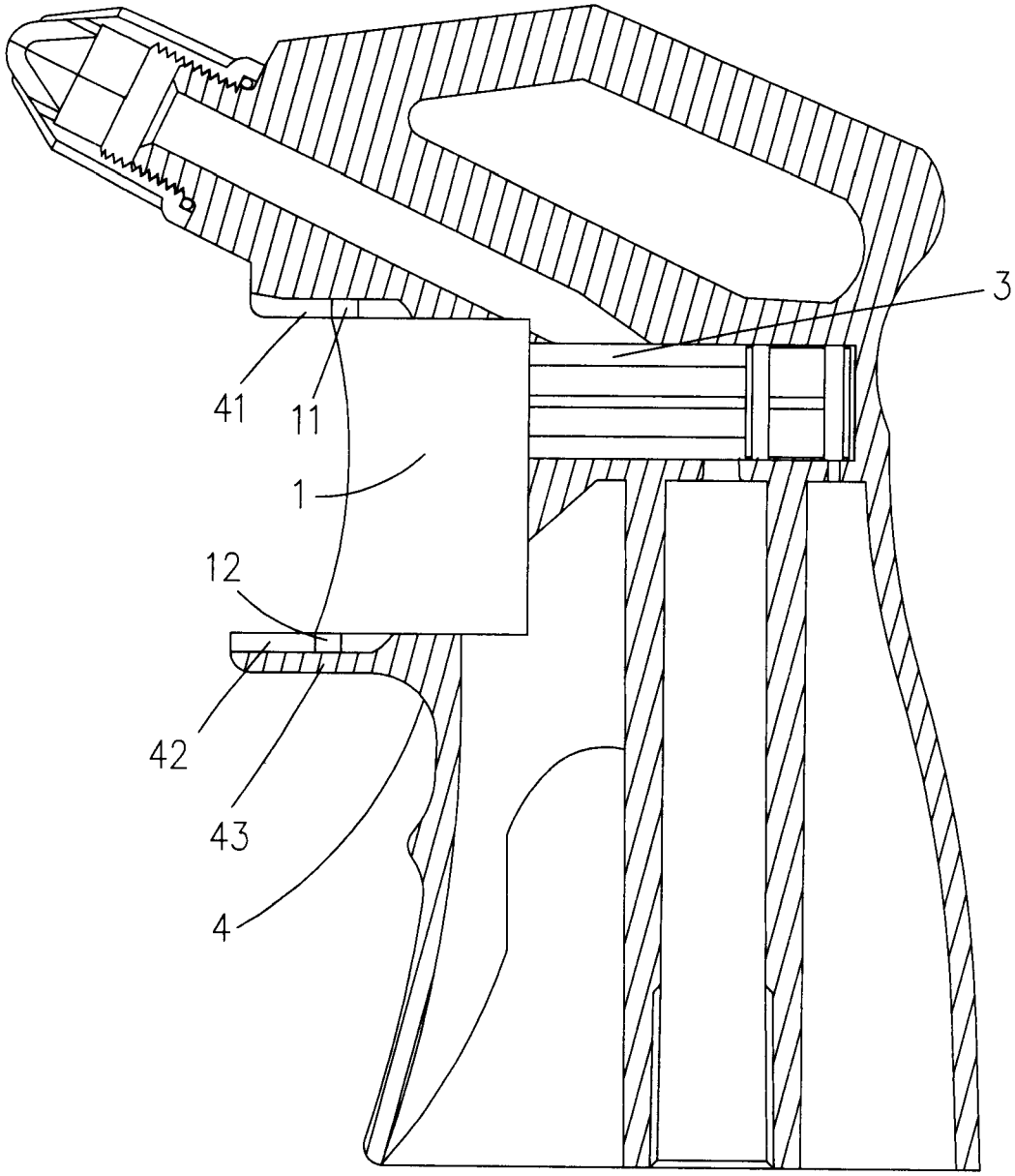
FIG 3 PRIOR ART
Figure 4:
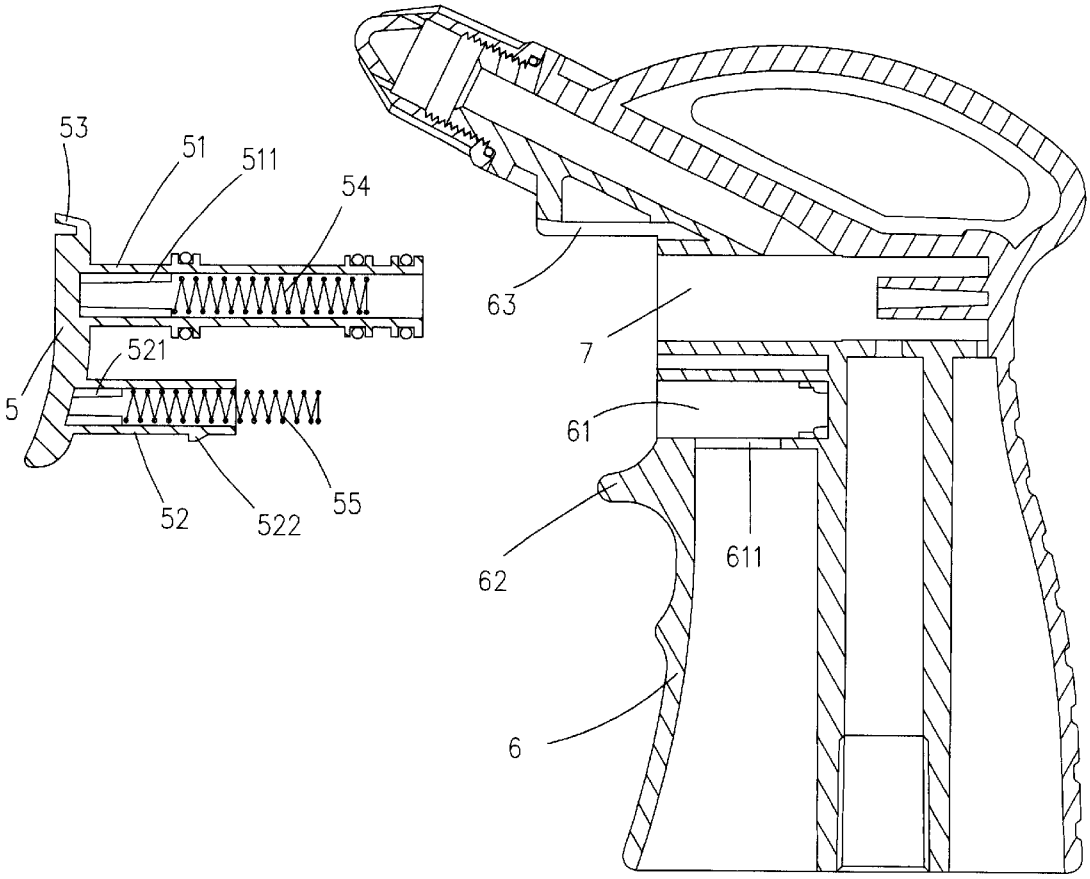
FIGS. 4 to 6 are sectioned side views showing the operation of a trigger structure for a spray gun according to the present invention.
Figure 5:
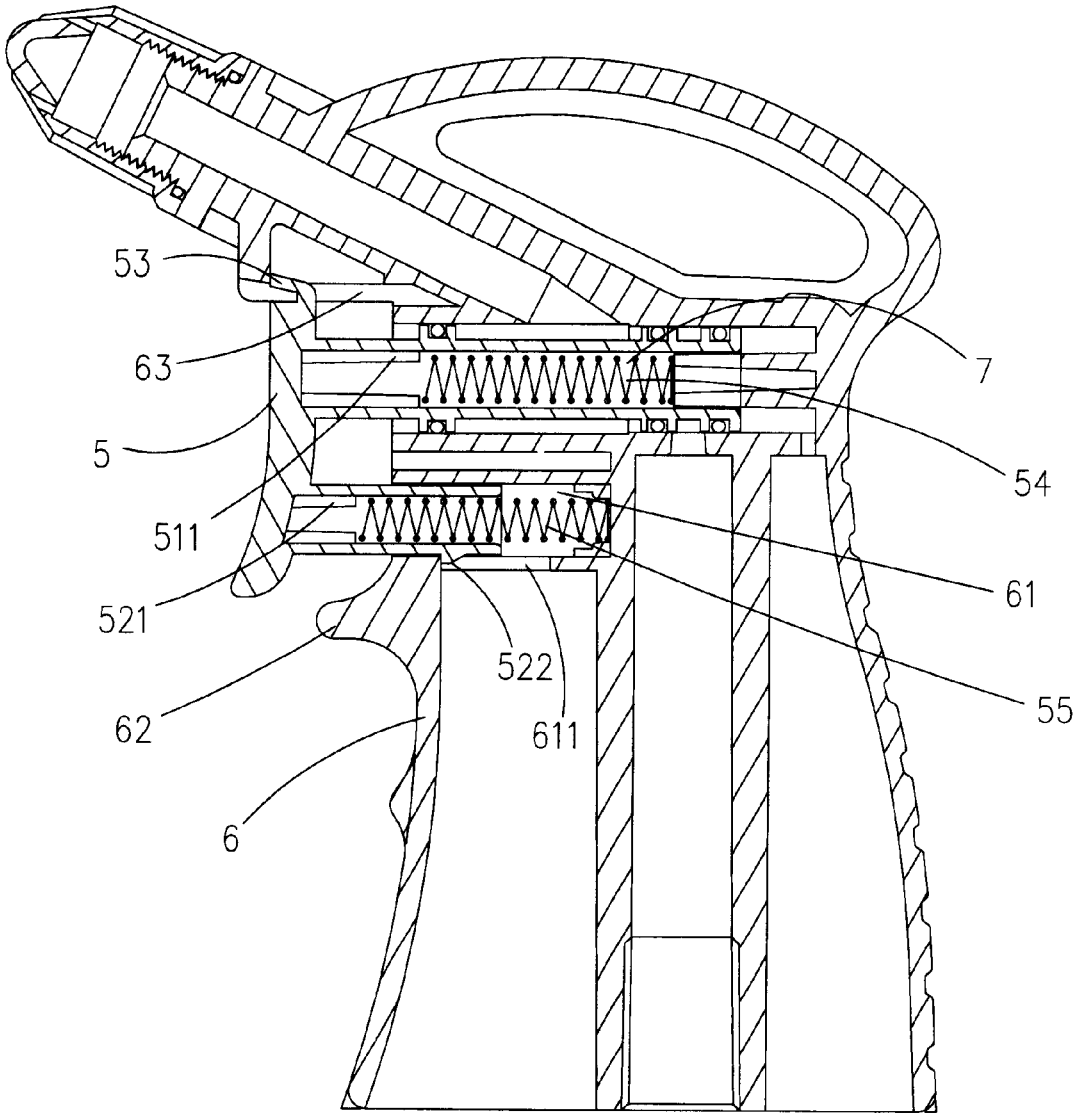
Figure 6:
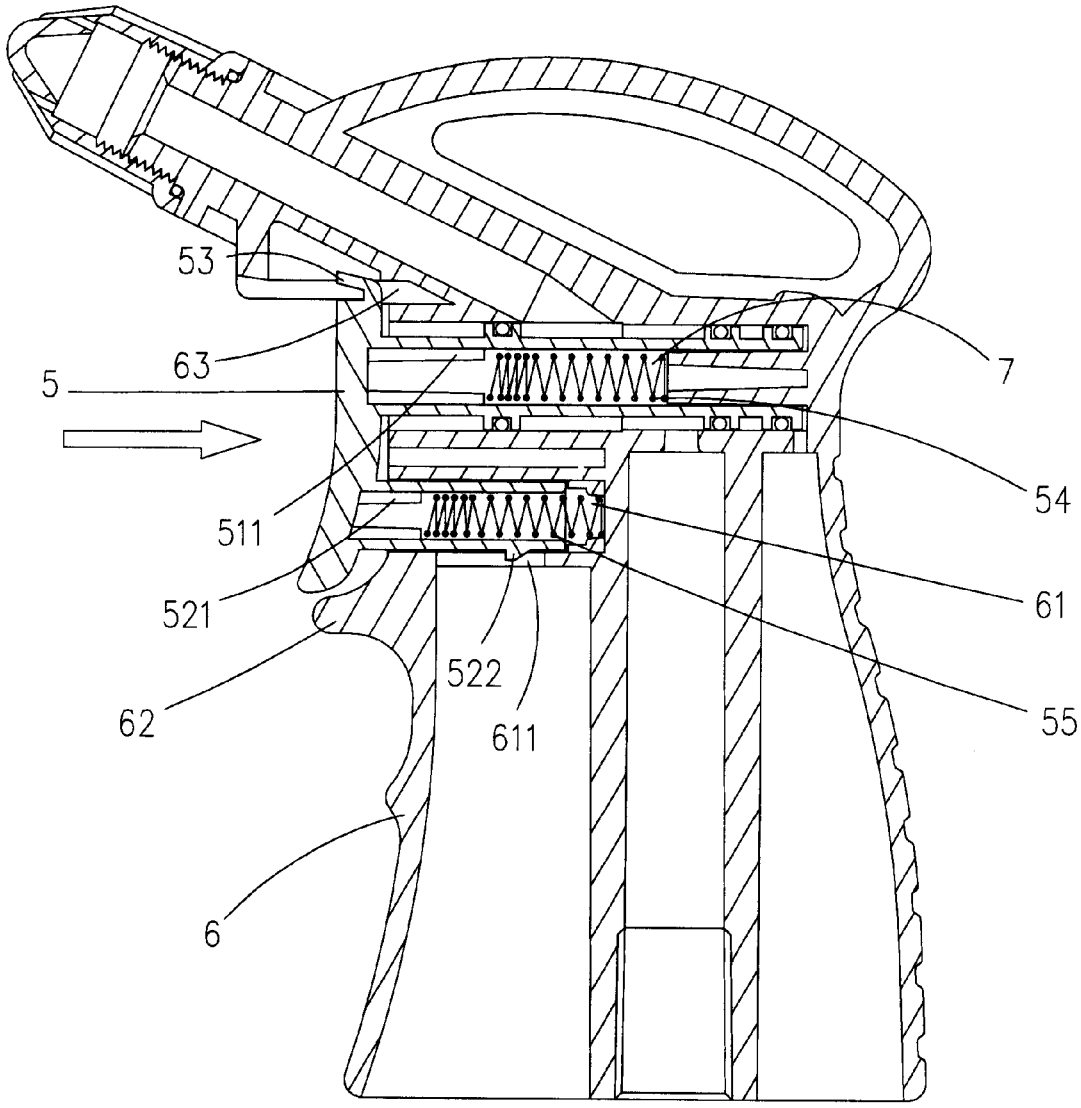

Please refer to FIGS. 4, 5, and 6 at the same time.

A trigger structure 5 for spray gun according to the present invention includes horizontally and rearward extended upper and lower driving shafts 51, 52. The upper and the lower driving shaft 51, 52 are two hollow members being internally molded with ribs 511 and 521, respectively. Compression springs 54, 55 with predetermined lengths are separately mounted in the hollow driving shafts 51, 52 with front ends pressed against free ends of the ribs 511, 521. An upper projection 53 is formed at an upper front of the trigger structure 5 above the upper driving shaft 51, and a lower projection 522 with predetermined dimensions is formed on an outer surface of the lower driving shaft 52 near a rear lower end thereof.

The spray gun for working with the trigger structure 5 includes a front handle 6, on which a horizontal lower channel 61 is formed to extend inward by a predetermined depth corresponding to the lower driving shaft 52. An axially extended groove 611 is provided on an inner bottom surface of the lower channel 61 for engaging with the lower projection 522 of the lower driving shaft 52. A front projection 62 is formed at an upper front of the front handle 6 to project therefrom by a predetermined distance. A horizontal upper channel 7 is formed in the spray gun on a top of the front handle 6 to extend inward by a predetermined depth corresponding to the upper driving shaft 51. A passage 63 is provided on the spray gun above and in front of a front opening of the upper channel 7 for the upper projection 53 of the trigger structure 5 to movably locate therein.

When the trigger structure 5 is assembled to the spray gun, the upper and the lower driving shaft 51, 52 are received in the upper and the lower channel 7, 61, respectively, with rear ends of the compression springs 54, 55 pressed against rear inner ends of the upper and the lower channel 7, 61, respectively, the upper projection 53 movably received in the passage 63, and the lower projection 522 movably received in the groove 611. An elasticity of the compression spring 54 mounted between the ribs 511 and the rear inner end of the upper channel 7, and of the compression spring 55 between the ribs 521 and the rear inner end of the lower channel 61 enables setting of a travel for the trigger structure 5 to move forward and rearward relative to the spray gun. The lower driving shaft 52 also forms a supporting point of the trigger structure 5 on the spray gun. By providing the ribs 511, 521 and the compression springs 54, 55, it is possible to set a start point of the travel of the trigger structure 5 at a suitable distance in front of the front projection 62 on the front handle 6, and a rear dead point of the travel of the trigger structure 5 at a position closely in front of the front projection 62. That is, when a user pulls the trigger structure 5 toward the spray gun by pressing a finger against an outer or front end of the trigger structure 5, the finger would never contact with the front projection 62 when the trigger structure 5 has reached the rear dead point of its travel. This arrangement allows the user to comfortably operate the spray gun.

What is claimed is:

1. A trigger structure for a spray gun, the spray gun including a handle having a horizontal upper channel and a lower channel provided thereon and open to a front portion of said handle, said trigger structure comprising:

horizontally and rearwardly extending upper and lower driving shafts movably engaged within said upper and lower channels, respectively, when said trigger structure is assembled to said spray gun; and an upper projection located at an upper front end of said upper driving shaft and received within a passage formed in said handle, positioned above and in front of said upper channel for guiding said upper driving shaft during actuation of said trigger structure.

2. The trigger structure for a spray gun as claimed in claim 1, wherein said lower channel on said handle of said spray gun is provided with an axially extending groove on an inner bottom surface of said lower channel.

3. A trigger structure for a spray gun, the spray gun including a handle having a horizontal upper channel and a lower channel provided thereon and open to a front portion of said handle, said trigger structure comprising:

horizontally and rearwardly extending upper and lower driving shafts movably engaged within said upper and lower channels, respectively, when said trigger structure is assembled to said spray gun, said lower driving shaft including a lower projection of predetermined dimensions located on an outer surface of said lower driving shaft near a rear lower end thereof, said lower channel having an axially extending groove formed therein, said lower projection being received within said groove for guiding said lower driving shaft during actuation of said trigger structure.

4. The trigger structure for a spray gun as claimed in claim 3, wherein said axially extending groove is formed on an inner bottom surface of said lower channel.

5. A trigger structure for a spray gun, the spray gun including a handle having a horizontal upper channel and a lower channel provided thereon and open to a front portion of said handle, said trigger structure comprising:

horizontally and rearwardly extending upper and lower driving shafts movably engaged within said upper and lower channels, respectively, when said trigger structure is assembled to said spray gun, wherein said upper and lower driving shafts are two hollow members and have ribs internally formed at predetermined positions, and biasing members within said driving shafts and engageable with said ribs for biasing said trigger structure to a nonactuated position.

6. The trigger structure for a spray gun as claimed in claim 5, wherein said biasing members within said upper and said lower driving shafts respectively are compression springs of a predetermined length internally mounted behind said ribs.

7. The trigger structure for a spray gun as claimed in claim 6, wherein said compression springs are pressed at rear ends against rear ends of said upper and said lower channels when said trigger structure is assembled to said handle of said spray gun, such that an elasticity of said compression springs enables said trigger structure to move forward and rearward within a predetermined distance relative to said handle.

* * * * *